United States Patent [19]

Doerrfeld

[11] Patent Number: 4,796,892

[45] Date of Patent: Jan. 10, 1989

[54] GOLF TRAINING AND PRACTICE DEVICE

[76] Inventor: Leonard G. Doerrfeld, 317 Pheasant Trail, Lake In The Hills, Ill. 60102

[21] Appl. No.: 67,005

[22] Filed: Jun. 29, 1987

[51] Int. Cl.[4] ..... A63B 69/36

[52] U.S. Cl. ..... 273/183 E; 273/186 C

[58] Field of Search ..... 273/183 E, 183 R, 26 E, 273/186 R, 186 C, 191 R, 192

[56] References Cited

U.S. PATENT DOCUMENTS

| | | | |
|---|---|---|---|
| 1,091,186 | 3/1914 | Brown . | |
| 1,677,261 | 7/1923 | Williams | 273/183 E |
| 2,669,782 | 2/1954 | Turner | 273/183 E |
| 3,269,733 | 8/1966 | Taddie | 273/186 R |
| 3,375,010 | 3/1968 | Panza . | |
| 3,554,555 | 1/1971 | Macri . | |
| 3,827,696 | 8/1974 | Schafer | 273/183 E |
| 3,853,325 | 12/1974 | Easterbrook . | |
| 3,942,802 | 3/1976 | Wright . | |
| 4,032,157 | 6/1977 | Carpenter . | |
| 4,647,042 | 3/1987 | Bruce | 273/26 E |

FOREIGN PATENT DOCUMENTS

| | | | |
|---|---|---|---|
| 2118049 | 10/1983 | United Kingdom | 273/183 E |

*Primary Examiner*—William L. Freeh

*Attorney, Agent, or Firm*—Mathew R. P. Perrone, Jr.

[57] ABSTRACT

A golf training and practice device has a base, an upwardly curving arm, and a two-piece sighting member. The base contains two fold-away spikes for stability when used on grass. The arm is attached to the base with an adjustable-friction ball and socket permitting movement in all directions. The sighting member consists of a lower (blade aligning) part having a clubhead line thereon, which is attached to the arm by a ball and socket, and into which is inserted an upper part having a swing path direction line, and an oval sighting aperture. The clubhead line is capable of being radially offset in increments from the swing direction line.

18 Claims, 3 Drawing Sheets

GOLF TRAINING AND PRACTICE DEVICE

BACKGROUND OF THE INVENTION

This invention relates to a golf training and practice device, and particularly to a golf training and practice device for aiding a golfer in an attempt to properly execute various desired golf shots.

Keeping one's head in a stable position throughout the entire golf swing is widely acknowledged to be the key to a successful golf shot. Many devices which address this need, are known in the art. Some are cumbersome and awkward to use. Others give indication errors in swing movement only after the completion of the golfer's swing.

Being able to cause the ball to curve in its flight path so as to avoid obstructions, or to counter the effect of a cross-wind is a valuable skill, much used to nearly all advanced golf players. Golfers of lesser ability can also benefit greatly by learning to execute these shots as well.

Proper focusing of eyes is also a critical part of the golf game. Use of sighting mechanisms is an important part of a biofeedback mechanism for assisting in the kinesiological and structural training of the muscles. There is more than one school of thought, which concludes that the use of two eyes is better than one even for sighting procedures such as firing a pistol or rifle. Use of the two eyes in sighting is sometimes referred to as binocular sighting.

By extrapolation, this two-eyed or binocular sighting advantage may also be applied to golf. One of the problems with a number of the prior art devices for teaching the proper golf swing is the fact that these devices limit the use of both eyes. Most devices to assist in the development of a golf swing are designed so that one eye is used. A device permitting the use of both eyes is desirable.

In golf, the most commonly sought shot is a straight shot. However, sometimes unintentionally, the golfer hits what is called a slice. For a right-handed golfer, a slice curves from left to right away from the golfer. For a left-handed golfer, a slice curves from right to left away from the golfer.

The opposite of a slice is a hook. For the right-handed golfer the ball curves from right to left, or toward the golfer. For the left-handed golfer a hook curves from left to right, or toward the golfer.

Both the hook and the slice refer to unintentional mis-directions of the ball. If a golfer has either one of these problems, great desire and effort are directed toward correcting this problem in order to keep the ball out of the rough and on the fairway to permit easier access to the green.

However, on a golf hole known as a dogleg which wherein the fairway leading to the green is not straight, and may curve or angle either to the left or right, a problem is created for the golfer. Clearly to correct the problems caused by a dogleg, a controlled, curving shot can have a good result. Thus, if the dogleg curves to the right, it is desirable to hit the ball so that it curves to right. A lefthanded golfer likes to hit a controlled hook. A righthanded golfer likes to hit a controlled slice for dogleg to the right.

An intentional (or desired) hook shot is called a draw. The intentional (or desired) slice shot is called a fade. Thus, if a right-handed golfer desires to achieve the same results as the slice and intentionally make his ball curve from left to right, the right-handed golfer attempts to hit what is called a fade shot. It is very difficult both to remove the unintentional slice from a right-handed golfer and to teach the right-handed golfer how to hit a fade shot when desired. Similar difficulties exist for a left-handed golfer.

In a like manner, when the right-handed golfer desires a fade shot, the left-handed golfer desires to hit a draw shot. In this fashion, if the dogleg is to the left, either a right-handed or left-handed golfer can traverse the dogleg and reduce the number of strokes used to reach the green. It is desired that a golfer avoid the slice or hook and hit the fade or draw as necessary.

Another use for a fade or draw is to get around a hill, a tree, or other obstacles in the path to the green. Furthermore, a golfer can use a fade or a draw to counteract the effect of cross-winds. In fact, overcoming the effect of cross-winds is the most important use for a controlled, curving shot. Thus, if a device can be developed to teach the golfer to hit a fade or a draw as desired and avoid the slice and the hook, a great advantage can be achieved.

Typically, golf training and practice devices may be used either inside or outside, but not in both places. If a golfer desires to practice his swing, both inside and outside, it is necessary to have two separate devices in most cases. It is highly desireable to develop a device that can be used either inside or outside to teach both the proper swing, and the "special" shots such as the "draw" shot and the "fade" shot.

It is difficult for the golfer to correct a hook or slice. It is also difficult for a golfing instructor to explain the mechanics of a hook or a slice at times. If a device can be develop to indicate the functions explained by the instructor, teaching of golf becomes simplified.

Typically it is difficult for a golf training and practice device to be adjustable to various statures of the different golfers. This causes a problem because it is difficult for the appropriate device to be on hand for the right person. If a golf training and practice device can be used for all sizes of people, great advantages are achieved.

It thus becomes clear that many problem exist in the development of an appropriate golf training and practice device.

SUMMARY OF THE INVENTION

Among the many objects of the present invention is to provide a golf training and practice device, which through visual feedback during the execution of the golf swing, causes the golfer to develop the skill to direct the shots as desired.

It is a further object of this invention is to provide a golf training and practice device capable of permitting the use of both eyes.

A still further object of this invention is to provide a golf training and practice device capable of being used indoors or outdoors.

Yet a further object of this invention is to provide a golf training and practice device capable of teaching a fade shot.

Also an object of this invention is to provide a golf training and practice device capable of teaching the draw shot.

Another object of this invention is to provide a golf training and practice device which can be used by the golfer to more easily acquire and develop the ability to hit a fade shot.

Another, specific, object of the present invention is to provide a golf training and practice device which can be used by the golfer to more easily acquire and develop the ability to hit a draw shot.

Still another object of this invention is to provide a golf training and practice device which is simple to construct.

Yet another object of this invention is to provide a golf training and practice device, which is effective in teaching the skills of aiming, ball striking, and putting, using all types of clubs, either indoors or out-of-doors.

It is a further object of this invention is to provide a golf training and practice device capable of assisting the golfer in keeping the head in a stable position.

A still further object of this invention is to provide a golf training and practice device, which is easy to use.

Yet a further object of the present invention to provide a golf training and practice device which is easily adjustable in all planes.

Also an object of this invention is to provide a golf training and practice device capable of equal ease of use for persons of any physical stature using any type of golf club.

Another object of this invention is to provide a golf training and practice device which can be used by the golfing instructor to more easily assist the golfer in acquiring and developing the ability to hit a fade shot or a draw shot.

These and other objects of this invention (which other objects become clear by considering the specifications, claims and drawings as a whole) are met by providing a golf training and practice device having a weighted base; a movable arm attached to the base at one end of the arm; and an adjustable, oval-shaped sighting mechanism movably attached to the other end of the arm and oppositely disposed from the weighted base.

BRIEF DESCRIPTION OF THE DRAWINGS

FIG. I is a perspective view of golf training and practice device 10 illustrating its relationship to a golfer 12 and to a golf ball 14.

FIG. II is a right side, elevation view of the golf training and practice device 10.

Figure 1:
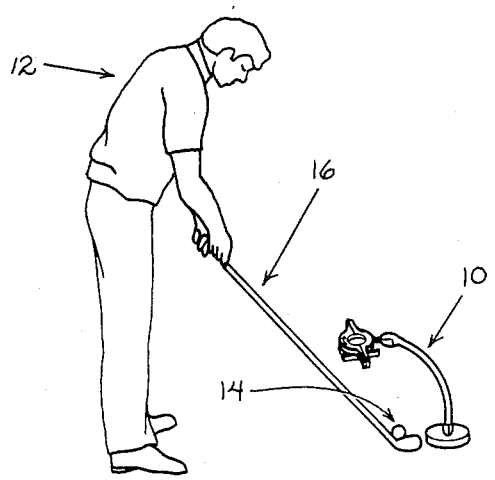
Figure 2:
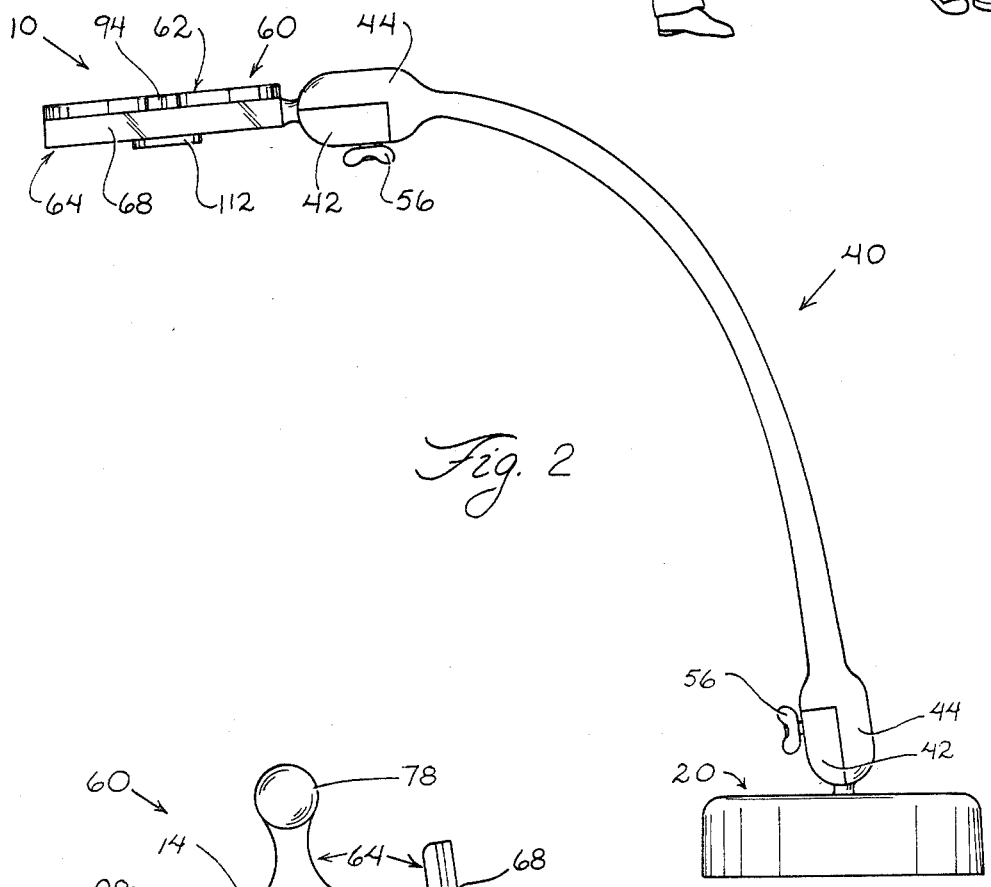
Figure 3:
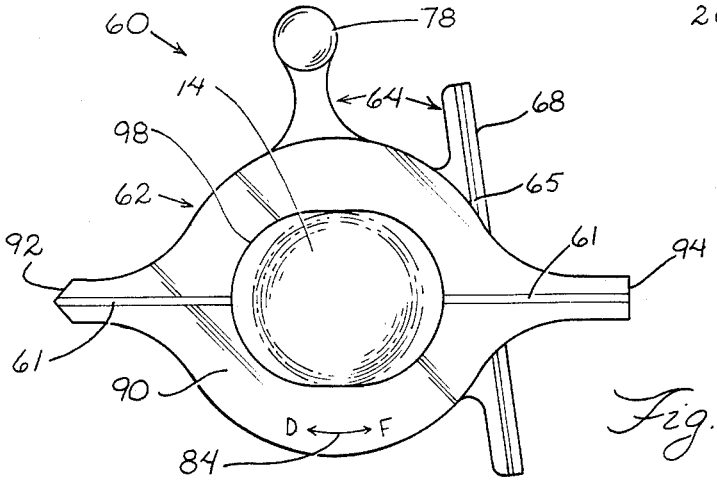
Figure 4:
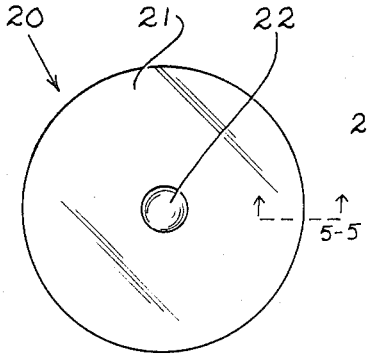
Figure 5:
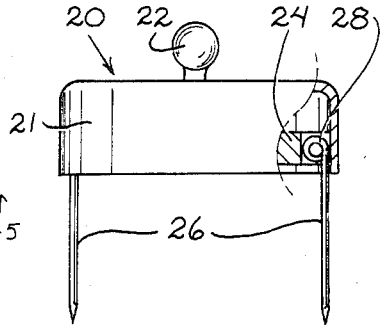
Figure 6:
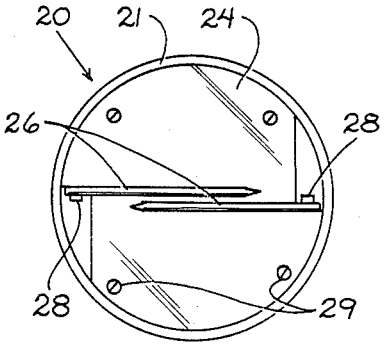
Figure 7:
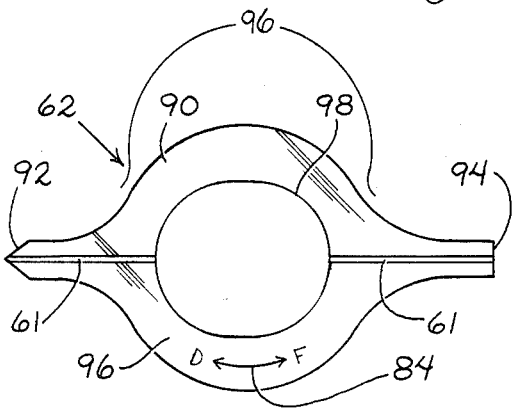
Figure 8:
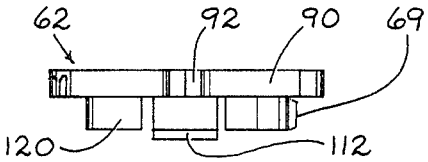
Figure 9:
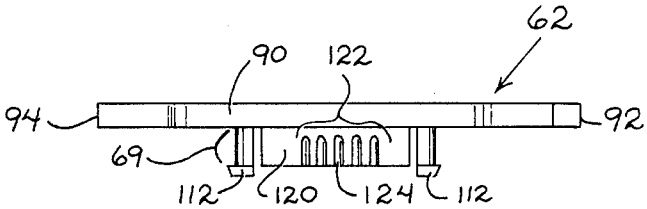
Figure 10:
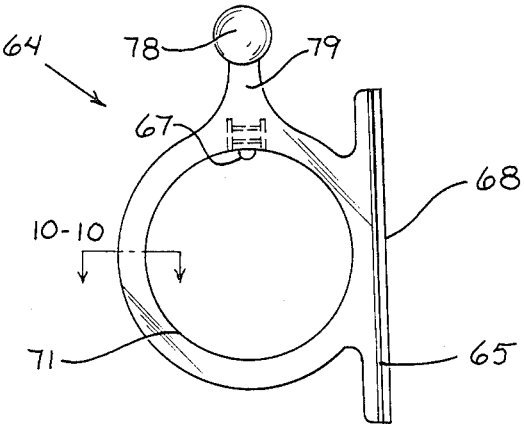
Figure 11:
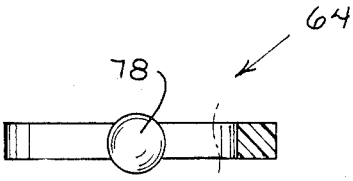
Figure 12:
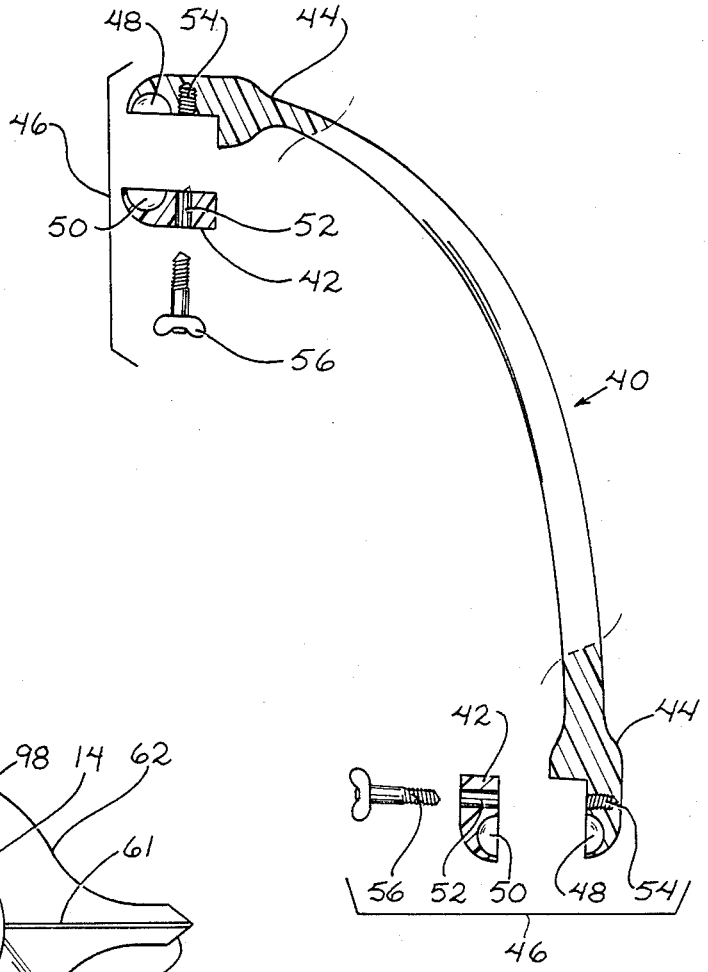
Figure 13:
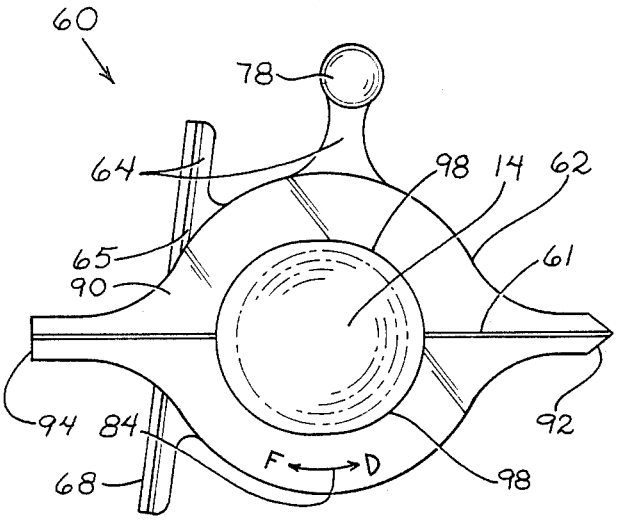

FIG. III is a top plan view of sighting member assembly 60 of golf training and practice device 10 for a right-handed golfer.

FIG. IV is a top plan view of base 20 of golf training and practice device 10

FIG. V is a side, elevation view of base 20 with spikes 26 extended having a partial section taken at Line 5—5.

FIG. VI is a bottom, plan view of base 20, with weight 24 and spikes 26 included and shown as retracted.

FIG. VII is a top, plan view of upper part 62 of sighting member assembly 60.

FIG. VIII is a left, elevation view of FIG. VII.

FIG. IX is a rear, elevation view of FIG. VII.

FIG. X is a top plan view of lower part 64 of the sighting member assembly 60.

FIG. XI is a rear, elevation view of lower part 64 of the sighting member assembly 60 with a partial section taken at Line 10—10.

FIG. XII is an exploded, side, elevation view of arm 40, and clamps 42 and thumbscrews 56 with a partial section taken at each end of arm 40.

FIG. XIII is a top plan view of sighting member assembly 60 of golf training and practice device 10 for a left-handed golfer.

Throughout the Figures of the drawings, where the same part appears in more than one Figure, the same numerical designation is applied thereto.

DESCRIPTION OF THE PREFERRED EMBODIMENTS

The golf training device of the present invention has a base so weighted and provided with retractable spikes as to provide for use indoors, outdoors with a practice mat (as at a driving range), or outdoors on a natural grass surface. The device includes an upward curving arm with hemispherical sockets (one at either end), and hemispherical clamps (one at each end); to provide for attachment to the base at one end, and to the sighting member at the opposite end. This factor facilitates ease of positional adjustment. The clamps provide adjustment of ease of movement with thumb screws.

A very critical portion of the device is the sighting member. The sighting member consists of two parts: the upper part which has a white swing-path line imprinted on its length, and the lower part which has a white club-alignment line imprinted on its breadth. The two parts are inserted one within the other, and normally the two lines are at right angles to each other, providing a proper sighting relationship for a straight shot. After pointing the swing-path line directly at the desired target, the golfer may then, by grasping the lowerpart and rotating the upper part, preset the desired degree of clubhead offset relative to the path-of-flight of the golf ball to create a double guide to follow in the execution of a "draw" or "fade" shot.

The upper part of the sighting member has an oval aperture in its center through which the golfer views the golf ball. The sighting member also serves as an aiming member, thereby becoming a sighting-aiming member. Keeping the ball always within the confines of this oval aperture during the complete swing insures that the golfer's head remains in a stable position. Regular use of the device in practice is intended to improve consistancy of good shots through kinesthetic muscle memory.

Referring now to FIG. I of the drawings the golf training device 10 of the present invention is depicted with relation to the golfer 12, to the ball 14 about to be struck and the club 16. The device 10 as seen in FIG. II consists of a base 20, an arm 40, and a two-piece sighting member 60. Sighting member 60 also serves as an aiming member, thereby becoming sighting-aiming member 60 and being referred to interchangeably as such. These parts combine to form the highly flexible and usable, golf training and practice device 10.

Referring to FIG. IV, FIG. V, and FIG. VI; the base 20 is seen to be comprised of a hollow circular shell 21, a spherical, base ball 22, a metal weight 24, two formed metal wire spikes 26, two spike screws 28, and four weight screws 29.

The base ball 22 serves as the attaching point for the arm 40 and to facilitate smooth movement of the arm 40 in all directions about the base 20. Base ball 22 is centrally located on the outer portion of base 20. Of course, other attaching means for the arm 40 may be used. Arm 40 may be made of flexible material to permit a fixed attachment to the base 20. However, the flexible attachment at base ball 22 for arm 40 is preferred for durability and ease of adjustment.

The weight 24 may be of cast metal having a weight of about one kilogram (a little over two pounds) and may be attached by means of weight screws 29 to the base 20 in the inner or hollow portion 23 thereof. The weight screws 29 are generally four in number and equally spaced around weight 24 in an appropriate pattern to provide a secure fit. It is also appropriate to use other fastening means. For example, weight 24 can be twist-locked into base 20. Weight screws 29 are preferred for a stronger and more durable device 10.

The spikes 26 may be formed of steel wire and pointed at their downward ends to permit insertion into turf or earth as conditions may dictate. The spikes 26 may be fastened to the weight 24 by spike screws 28 to permit the lowering or retracting of said spikes 26 as need may dictate.

The base 20 and ball 22 may be molded or formed of plastic or metal material either separately, and then assembled as a unit, or together as one entity. Preferably, the base 20 has a dark, flat color so as to minimize glare, which might distract the golfer.

The arm 40 as seen in FIG. II and FIG. XII serves to hold the sighting member 60 in the proper position between the golf ball 14 and the golfer's 12 line of vision when at address to the golf ball 14. The arm 40 is a long, arced, rod-like member of any suitable shape. The arm 40 is fastened to both the base 20 and the sighting member 60 by means of a clamp assembly 46 at each end of arm 40. The arm 40 may have an I-beam cross-section for ease of molding. Most preferrably, the arm 40 is in the shape of approximately one-quarter of an ellipse.

Each of clamp assemblies 46 (as described in partial section drawing in FIG. XII) is symmetrical for ease of manufacture, although they may be of different types if desired. Clamp assembly 46 includes an arm piece 44 as a part of arm 40 and a free piece 42, which is securable to arm piece 40. Within arm piece 44 is first receiving hemispherical cavity 48. Within free piece 42 is a second hemispherical receiving cavity 50. First receiving cavity 48 and second receiving cavity 50 combine to enclose ball 22 and secure arm 40 to base 20.

Free piece 46 includes a screw aperture 52 which aligns with screw receiver 54. Thus base ball 22 may be enclosed in first receiving cavity 48 and second receiving cavity 50. Thumbscrew 56 passes through screw aperture 52 into threaded relation with screw receiver 54 to thereby enclose and secure ball 22 therein, and thence secure arm 40 to base 20. The arm 40 may be freely moved to any required position by the golfer 12, and can stay as positioned—resisting movement by wind or gravity.

The arm 40 must also be of dark flat color so as to minimize glare which might distract the golfer. The arm 40 may be molded or formed of plastic or metal material of such stiffness and thickness as to resist being moved by any moderately windy condition.

As seen in FIG. III the sighting member 60 is the two-piece assembly of the upper part 62 and the lower part 64. Referring now also to FIG. VII, FIG. VIII, FIG. IX, FIG. X, and FIG. XI, the method of use and means of assembly of the sighting member 60 is fully revealed. The upper part 62 is inserted downward into the lower part 64 as though FIG. IX were lowered into FIG. XI. The outside diameter 69 of upper part 62 fits closely into the inside diameter 71 of lower part 64.

Upper part 62 includes a visible sighting flange 90 and a lower mating section 69. It is lower mating section 69, which fits into lower part 64 in order to permit upper part 62 and lower part 64 to form sighting member 60. Sighting flange 90 of upper part 62 has a pointed end 92 to indicate the direction of desired golf ball 14 flight and a blunt end 94. Blunt end 94 and pointed end 92 are diametrically opposed to each other. Pointed end 92 appears to be like the head of an arrow. Blunt end 94 appears to be like the shaft of an arrow.

Between blunt end 94 and pointed end 92 is oval section 96. Oval section 96 is an enlarged portion, with oval aperture 98 therein. The long axis of oval aperture 98 runs from blunt end 94 to and through pointed end 92, and bisects oval aperture 98. The long axis is clearly indentified by sighting line 61 engraved or imprinted on visible sighting flange 90.

Still considering FIG. III along with FIG. I, because of the distance ratio of the golfer's 12 eyes from the sighting member 60 to the golf ball 14, and because a person sees with binocular vision, the size and shape of the oval aperture 98 in the upper part 62 of the sighting member 60 becomes critical to the golfer 12 being able to accurately see the fullness of the golf ball 14 when the golfer 12 is at his normal address position.

A height along the vertical axis of oval aperture 98 as seen in FIG. III must be no less than seventy five (75%) percent of the diameter of a standard golf ball 14, and no greater than one hundred two (102%) percent of the diameter of the golf ball 14. The optimum height and most preferred height along the vertical axis of oval aperture 98 must be no less than eighty (80%) percent of the diameter of a standard golf ball such as golf ball 14, and no greater than one hundred (100%) percent of the diameter of the golf ball 14.

An operable width along the horizontal axis of the oval aperture 98 as seen in FIG. III is no less than one hundred eight (108%) percent of the diameter of the golf ball 14, and no greater than one hundred twenty five (125%) percent of the diameter of the golf ball 14. The optimum width and most preferred width along the horizontal axis of the oval aperture 98 is no less than one hundred ten (110%) percent of the diameter of the golf ball 14, and no greater than one hundred twenty (120%) percent of the diameter of the golf ball 14.

These size restrictions, along with some adjustment of the sighting member 60 in conjunction with the arm 40 in vertical height from the ground (to be made by the golfer so that the sighting member 60 is between the shins and the knees of the golfer 12) assures that the golf ball so perceived will be closely contained within the oval aperture 98, yet be fully visible in its entirety. The aforementioned size and positional requirements further assure that the golfer will be constrained in the movement of his head during the golf swing and that the golfer's attention will be narrowly directed toward the golf ball 14 and its desired flight path to the exclusion of visual distractions which otherwise might detrimentally influence the golf shot.

Considering now FIG. X and FIG. XI in order to discuss lower part 64, lower part 64 is a hollow cylinder in nature. Centrally located therein is a circular aperture 71. Within circular aperture 71 is a spring action half cylinder detent 67, which engages one of several half cylindrical detent slots 122, in lower mating section 69 of upper part 62. The central detent slot 124 of cylindrical detent slots 122 aligns sighting line 61 and clubhead line 65 at 90° with respect to each other. This is the setting for a straight shot.

Lower part 64 has a line bar 68 which appears to be substantially tangential to circular aperture 71. Line bar 68 has clubhead line 65 set thereon. Spring action half cylinder 67 is on the interior of circular aperture 71. On lower part 64 and adjacent to spring action half cylinder 67 on the outside of circular aperture 71 is spherical knob 78. Spherical knob 78 is a molded part of lower part 64, is connected thereto by neck 79, and may be molded unitarily therewith. The location of spherical knob 78 may indicate the location of spring action half cylinder detent 67 although other locations are suitable therefor.

A brief reference back to FIG. IX shows the locking mechanism of lower part 64 to upper part 62 by lower mating section 69. Lower mating section 69 includes a detent block 120 flanked on either by a pair of oppositely disposed snap tabs 112. Each snap tab 112 of the pair cooperates with lower part 64 to hold upper part therein. Detent block 120 and each snap tab 112 combine to give a circular appearance. The lock of snap tabs 112 with lower part 64 combined with sighting flange 90 holds upper part 62 in position.

Sighting member 60 is secured to arm 40 by clamping assembly 46 at spherical knob 78 in the same fashion that arm 40 is secured to base ball 22. In this fashion, sighting member 60 is movable with respect to arm 40 just like arm 40 is movable with respect to base 20.

To position the sighting member 60 for other than a straight shot (that is a "draw" or a "fade" shot), the following sequence of actions by the golfer 12 may be employed: first the sighting member 60 being at its normal setting (90% swing path line 61 to clubline 65) is pointed directly at the desired target. Next the lower part 64 is grasped in one hand and the upper part 62 is grasped by the other hand. Next the upper part 62 is rotated in the direction suggested by the legend 84 (including a "D" indicating draw, an "F" indicating fade and an arrow showing direction to "D" or "F") which is imprinted on the top surface of the upper part 62. Th degree of rotation may be judged by sensing the number of clicks of detent 67 acting in slots 122. Other legends or indicia may be used as may other detent means.

Once the device 10 is positioned as desired, the golfer 12 stands at his normal address position with respect to the golf ball 14 and the swing path line 61 and then adjusts the position of the sighting member 60 so that the ball 14 is perceived as being centrally located within the confinces of the oval aperture 98. Lastly the golfer 12 adjusts the blade of his golf club 16 to be parallel with clubhead line 65 and then proceeds to execute the golf shot, all the while keeping the golf ball 14, as perceived, within the confines of the aperture 98.

The sighting member 60 may be molded or formed of plastic or metal material and is preferrably of a dark, flat color so as to minimize glare which might cause a distraction to the golfer 12. The swing path line 61, clubhead line 65 and the legend 84 are preferably white in color and permanently imprinted on the top surfaces of the sighting member 60. Arm 40 may be made of any rigid mate rial, as may base 20 and sighting member 60. A moldable plastic or synthetic resin is preferred.

All of the preceding description of the preferred embodiment of the present invention has been made with reference to a device 10 as configured for use by a right-handed golfer 12.

Another embodiment of the present invention as shown in FIG. XIII for use by left-handed golfers may be produced by employing the following four modifications to the sighting members 60. Lower part 64 is rotated 180° so that linebar 68 is leftward as in FIG. XIII. Upper part 62 is inserted from above as before but with pointed end 92 rightward as in FIG. XIII. Clubhead line 65 is now imprinted on the upper surface (formerly lower surface) of lower part 64. Legend 84 is now imprinted the top surface of upper part 62, and spaced one eighty (180°) degrees apart from the area depicted in FIG. III and with the letters "D" and "F" transposed.

From the foregoing description it can be seen that the golf training and practice device of the present invention 10 provides several means of aiding the golfer in the attainment of (but not limited to), the following skills: correct aiming of straight shots to target; correct striking of the golf ball with all manner of golf clubs; execution of various degrees of "draw" or "fade" shots.

Two embodiments of the device 10 have been disclosed herein with considerable detail.

Other modifications can be made thereto with respect to material, shape, indicia, and size of members thereof without departing from the spirit and scope of the invention.

This application—taken as a whole with the specification, claims, abstract, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modifications of this method and apparatus can become clear to a person having ordinary skill in this particular art. Such modifications are clearly covered hereby.

What is claimed and sought to be secured by Letters Patent of the United States is:

1. A golf training and practice device for use by a golfer and a golf training instructor wherein said device includes:

a. a base having a weight means secured thereto for stability;

b. an arcuate arm extending in an upward curve from said base and movably attached to said base at a first end of said arm;

c. a sighting-aiming member movably attached to said arm at a second end of said arm, said second end being oppositely disposed from said first end;

d. said sighting-aiming member has an oval-shaped sighting aperture capable of providing a binocular view of a golf ball;

e. said sighting-aiming member includes an upper part and a lower part;

f. said upper part has a swing-path line on a longest portion thereof;

g. said lower part has a club-alignment line on a breadth of said lower part; and h. said upper part includes a mating section to secure said upper part to said lower part.

2. The golf training and practice device of claim 1 wherein said arm is attached to said base at said first end by a base mechanism of the ball and socket type, thereby permitting movement and adjustment of said arm.

3. The golf training and practice device of claim 1 wherein said sighting-aiming member is attached to said arm at said second end by a sight mechanism of a sight ball and a sight socket, thereby permitting movement and adjustment of said sighting-aiming member.

4. The golf training and practice device of claim 3 wherein said mating section of said upper part provides a rotatable relation with said lower part, thereby permitting rotation of said upper part within said lower part.

5. The golf training and practice device of claim 4 wherein:

a. said arm is attached to said base by a base ball and a base socket;

b. said base ball is centrally located on an exterior portion of said base; and c. said base socket is situated in said first end of said arm.

6. The golf training and practice device of claim 5 wherein:

a. said sight ball is part of said sighting-aiming member;

b. said sight socket is situated at said second end of said arm.

7. The golf training and practice device of claim 1 wherein:

a. said swing-path line is imprinted on said longest portion of said upper part; and b. said club-alignment line is imprinted on said breadth.

8. The golf training and practice device of claim 7 wherein a positioning means holds said upper part in a relationship with said lower part so that said swing-path line is at a right angle with said club-alignment line.

9. The golf training and practice device of claim 8 wherein said positioning means includes a plurality of slots to cooperate with a detent.

10. The golf training and practice device of claim 9 wherein said positioning means holds said upper part in a relationship with said lower part so that said swing-path line is at an angle with said club-alignment line to create a guide to follow in executing a draw shot or a fade shot.

11. The golf training and practice device of claim 10 wherein:

a. said base socket and said sight socket are formed by a symmetrical clamp;

b. said clamp includes an arm piece as a part of said arm at each end of said arm and a free piece;

c. said free piece is removably secured to said arm piece; and d. said free piece and said arm piece combine to receive said base ball or said sight ball.

12. The golf training and practice device of claim 11 wherein:

a. said base includes a hollow, cylindrical shell with a closed, flat side one end thereof;

b. said base ball is centrally located on said closed flat side;

c. said weight means is secured within said hollow cylindrical shell; and d. a retractable, ground penetrating means is secured adjacent to said weight means.

13. The golf training and practice device is claim 22 wherein said retractable ground pentrating means includes a pair of spikes.

14. The golf training and practice device of claim 1 wherein:

a. a height along the vertical axis of said oval aperture is no less than seventy five percent of the diameter of said golf ball and no greater than one hundred two percent of the diameter of said golf ball; and b. a width along the horizontal axis of said oval aperture is no less than one hundred eight percent of the diameter of said golf ball and no greater than one hundred twenty five percent of the diameter of said golf ball.

15. The golf training and practice device of claim 14 wherein:

a. said height along the vertical axis of said oval aperture is no less than eighty percent of the diameter of said golf ball and no greater than one hundred percent of the diameter of said golf ball; and b. a width along the horizontal axis of said oval aperture is no less than one hundred ten percent of the diameter of said golf ball and no greater than one hundred twenty percent of the diameter of said golf ball.

16. The golf training and practice device of claim 15 wherein:

a. said lower part includes line bar having a substantially tangentially relation thereto; and b. said line bar includes said clubhead line.

17. The golf training and practice device of claim 1 wherein:

a. said upper part includes a sighting flange and a lower mating section;

b. said lower mating section of said upper part fits into said lower part;

c. said sighting flange has a pointed end to indicate a desired direction for said golf ball and a blunt end diametrically opposed to said pointed end;

d. an oval section is situated between said blunt end and said pointed end;

e. an oval aperture is centrally located in said oval section; and f. a sighting line is centrally located on said blunt end and said pointed end.

18. The golf training and practice device of claim 17 wherein said arm is one-fourth of an ellipse.

* * * * *